United States Patent [19]

Inouye et al.

[11] 4,328,749

[45] May 11, 1982

[54] INFORMATION RECORDING METHOD AND APPARATUS, AND A HALF-PRODUCT OBTAINED THEREBY

[75] Inventors: Yoshinori Inouye, Kyoto; Akio Ando, Otsu; Ryuichi Nakahashi, Tokyo, all of Japan

[73] Assignee: Toray Industries, Inc., Tokyo, Japan

[21] Appl. No.: 87,192

[22] Filed: Oct. 22, 1979

[30] Foreign Application Priority Data

Oct. 26, 1978 [JP] Japan ..... 53-131794

[51] Int. Cl.[3] ..... B41F 19/00

[52] U.S. Cl. ..... 101/426; 101/93.12; 101/92; 101/228; 101/142; 101/143; 101/137; 101/138; 101/176; 101/181; 400/77; 400/119; 400/578; 400/613.2; 400/118; 271/9

[58] Field of Search ..... 101/93.11, 93.12, 93.20, 101/90, 66, 92, 226–228, 141, 142, 144, 137, 138, 143, 176, 181; 400/68, 77–81, 104, 105, 118, 119, 126, 124, 578, 579, 580, 613.2; 271/9

[56] References Cited

U.S. PATENT DOCUMENTS

| | | | |
|---|---|---|---|
| 2,893,310 | 7/1959 | Johnson | 101/182 |
| 3,037,202 | 5/1962 | McNaney | 101/93 |
| 3,139,025 | 6/1964 | Chambon | 101/92 |
| 3,340,801 | 9/1967 | Shoup | 101/90 |
| 3,426,678 | 2/1969 | Carper et al. | 101/141 |
| 3,527,164 | 9/1970 | Bulk | 101/184 |
| 3,576,367 | 4/1971 | Sable | 101/226 |
| 3,658,163 | 4/1972 | Sniderman | 400/583.3 |
| 3,673,953 | 7/1972 | Massari | 101/30 |
| 3,768,402 | 10/1973 | Levesqne et al. | 101/92 |
| 3,774,535 | 11/1973 | Crissy | 101/142 |
| 4,059,260 | 11/1977 | Stange et al. | 271/9 |
| 4,082,039 | 4/1978 | Schutt et al. | 101/142 |
| 4,099,810 | 7/1978 | Stange | 271/9 |
| 4,150,621 | 4/1979 | Raible | 101/207 |

*Primary Examiner*—William Pieprz

*Attorney, Agent, or Firm*—Austin R. Miller

[57] ABSTRACT

A method for recording a variant information and a steady information onto a recording medium, wherein the variant information and an identification information for designating the steady information which is to be recorded later are first recorded, and the identification information is then read to select a desired steady information from a plurality of pieces of stored steady information in accordance with the read identification information, and finally, the selected steady information is recorded on the recording medium. An apparatus for effecting the method is also disclosed.

7 Claims, 6 Drawing Figures

INFORMATION RECORDING METHOD AND APPARATUS, AND A HALF-PRODUCT OBTAINED THEREBY

This invention relates to a method for recording information on a recording medium, an apparatus for effecting the method, and a recorded half-product obtained by the method, and is particularly advantageous when various kinds of information have to be alternately or substitutionally recorded on the medium.

Documents, such as power, gas or water bills, issued from power, gas or water supply companies, medical fee bills which are issued from medical institutions to insurance institutions, or registers which are generally used in government offices or private enterprises, often include one kind of columns which have recorded information, such as issue dates, or addresses and names of recipients, and another kind of columns which have recorded information, such as headings of documents, lines which are one kind of information to be recorded for dividing the column into several parts, addresses and names of issuers. The first kind of columns and the information recorded therein are referred to as "variant portions" and "variant information", respectively, hereinafter, since the information recorded in the first kind of columns has different contents for every bill or every register. The second kind of columns and the information recorded therein are referred to as "steady portions" and "steady information" respectively, hereinafter, since the information is in many cases common to every bill or every register. The steady and variant information usually consist of characters, marks, letters, or figures.

In one conventionally known method of obtaining a recorded product on which are recorded variant information and steady information, it is necessary to provide a pre-recorded medium on which is pre-recorded the necessary steady information, and then to record, for example, print, the necessary variant information at a predetermined position on the pre-recorded medium by means of recording machinery, such as an impact printer controlled by a computer. However, this prior art method requires the provision of a predetermined number of the pre-recorded mediums and has the following drawbacks.

1. Various kinds of pre-recorded mediums have to be prepared. For example, a large number of gas bills which are issued from a gas supply company and which have pre-recorded steady information, and different colours and patterns, have to be prepared to distinguish, for example, domestic customers from corporation customers. This results in the requirement for a large space for storing the bills and in difficult and complex provisions and actions for maintenance of the same.

2. It is difficult to feed a predetermined number of pre-recorded mediums having desired patterns and colours into a recording machine, such as a printer, for recording variant information on the pre-recorded mediums, with high precision of positioning of the pre-recorded mediums. Consequently, the recording machine cannot operate efficiently and the recording speed of the documents is low.

It is also known to record variant information and steady information at one time on a medium by using steady information recording machine, such as a printer controlled by a computer, which stores the necessary steady information. However, this prior art has the following drawbacks.

1. The printing quality of the steady portions is poorer than with the above mentioned prior art in which pre-recorded mediums are used.

2. It is difficult to record or print the steady information on the steady portions, in various kinds of colour inks.

3. Since the information processing is rather difficult, the printing speed is substantially lower than with the above mentioned prior art.

Alternatively, there is also known an information recording apparatus which records steady information by means of a film overlay method. However, this known apparatus also has the drawbacks of poor printing quality and difficulty in multi-coloured printing.

The primary object of the present invention is to provide a method for recording steady information and variant information on a medium, in which the variant information is first recorded on the medium and the steady information is then recorded on the medium, the recording of both of the kinds of information being effectively and speedily effected, to eliminate the above mentioned drawbacks.

Another object of the invention is to provide an apparatus for effecting the above mentioned method.

Still another object of the invention is to provide a recorded half-product obtained by the apparatus and the method of the present invention.

According to the present invention, there is provided a method for recording at least one steady information and at least one variant information which is to be recorded with a predetermined positional relationship to the steady information on a recording medium, comprising; recording the variant information and at least one identification information for identifying an steady information which is to be recorded later on said recording medium; reading the recorded identification information to select a desired steady information corresponding thereto from a plurality of pieces of stored steady information, and; recording the selected steady information on said recording medium with said predetermined positional relationship to the recorded variant information.

According to the present invention, there is also provided an apparatus for recording at least one steady information and at least one variant information which is to be recorded at a specified positional relationship to the steady information, onto a recording medium, comprising; a first recording means comprising means for feeding the recording medium to a recording station, means for recording the variant information and at least one identification information for identifying an steady information which is to be recorded later onto said recording medium, and means for discharging the recording medium having the recorded variant information and the recorded identification information, and; a second recording means comprising means for feeding the recording medium discharged from said first recording means to a recording station, means for reading the recorded identification information to select a desired steady information corresponding thereto from a plurality of pieces of steady information, and means for recording the selected steady information on said recording medium with said specified positional relationship to the recorded variant information, and means for discharging the finished recording medium.

Furthermore, according to the present invention, there is provided a recording medium which is a half-product obtained by the above mentioned method of the invention, comprising at least one recorded variant information and at least one recorded identification information for identifying the steady information which is to be recorded later steady the recording medium.

Further properties of the invention will become apparent from the detailed description which follows hereinafter.

Preferred embodiments of the invention are illustrated in the accompanying drawings, in which.

Figure 1:
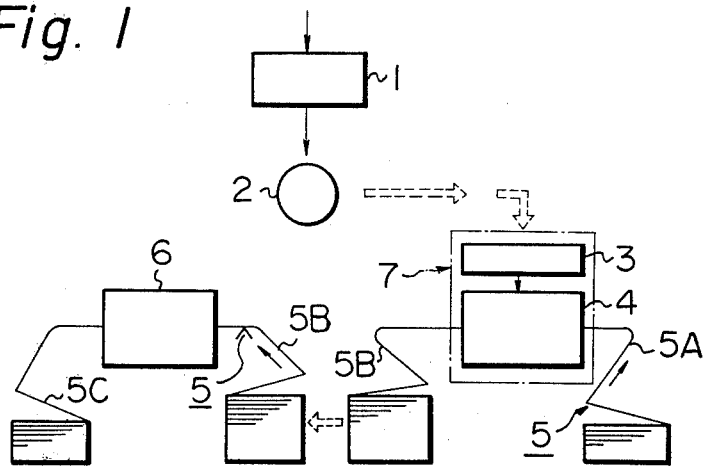
FIG. 1 is a view schematically illustrating a printing method according to an embodiment of the present invention.

Referring to FIG. 1 which illustrates a printing method according to the first embodiment of the invention, the numeral 1 designates a data processing unit 1, such as a computer which processes information or data. When the unit 1 receives variant information which is to be printed on desired pages of a continuous folded paper 5 and identification information which designates steady information which is to be printed on the pages of the paper 5, these pieces of information are coded, for example, in such a way that four digit numbers are combined in B.C.D. fashion, and are then output. The output, i.e. the coded variant information and the coded identification information, is recorded and stored on a magnetic recording tape 2 of an external storage (not shown).

The numeral 7 designates a first printer comprising a generator 3 which generates characters, figures, letters, or marks and which is referred to as "a character generator" hereinafter, and a printing portion 4. The character generator 3 has a reproduction mechanism of the tape 2, so that when the tape 2 is placed in the character generator 3 and is reproduced, fonts which are graphic patterns consisting of a large number of small dots and which correspond to the codes of the variant information and the identification information, are output at the printing portion 4. When the printing portion 4 receives the outputs from the character generator 3, the printing portion prints the variant information on a predetermined portion of a predetermined page of the paper 5, which is fed in a direction shown by an arrow, and records the identification information which designates the kinds of steady information to be printed later on the pages. It should be noted that it is not always necessary to print the identification information on every page of the paper 5. The paper on which no information has been recorded or printed is referred to as "a primary paper 5A".

After the variant information and the identification information are recorded on the primary paper 5A, the paper is fed to a second printer 6 for printing the steady information. The paper on which the predetermined variant information and the predetermined identification information have been recorded is referred to as "a secondary paper 5B". In the embodiment illustrated in FIG. 1, the secondary paper 5B is fed to the second printer 6 in a direction which is the same as the direction of the feed of the primary paper 5A into the first printer 7.

The second printer 6 includes means for feeding the secondary paper 5B, means for reading the identification information on the secondary paper 5B, and means for selecting the desired steady information corresponding to the steady information designated by the identification information, among a plurality of pre-prepared or stored steady information, and for printing the selected steady information on the secondary paper 5B, these means not being shown in FIG. 1. Thus there can be printed on the secondary paper 5B, on which has been printed the above mentioned information by the first printer 7, the steady information which is designated by the identification information.

In the above mentioned embodiment, it is also possible to directly connect the unit 1 to the character generator 3 of the first printer 7, thereby to directly input the outputs of the unit 1, i.e. the coded variant information and the coded identification information, into the character generator 3, by using memories (not shown) stored in the unit 1. In this case, provision of the external storage having the magnetic recording tape 2 is not necessary. However, an external storage can be provided for off-line operation of the data processing unit 1 and the printer 7, since memory devices, such as magnetic tapes or magnetic discs of the external storage, can then be displaced anytime and anywhere.

Figure 2:
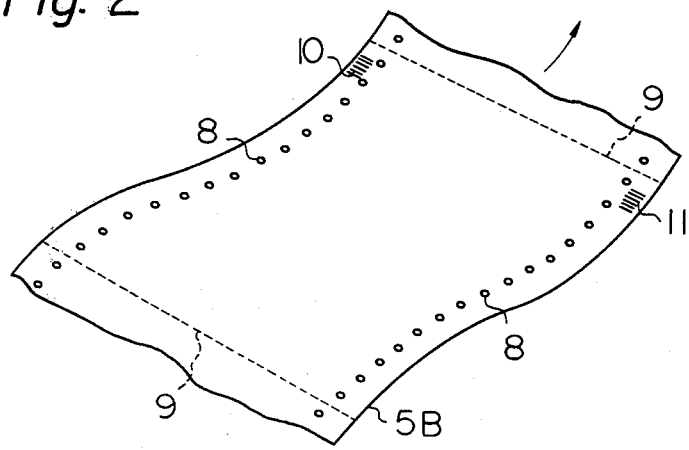
FIG. 2 is a perspective view of a part of a continuous paper of the present invention having two kinds of identification information.

The continuous folded paper 5 can be replaced by sheets of separate papers or by continuous rolled paper. The paper 5 which is in the form of a continuous folded paper usually has a series of perforations or sprocket holes 8 on its opposite sides along the length of the paper, as illustrated in FIG. 2, and has notches 9 which define each page of the paper. The paper 5 is folded along the notches 9. In the case of a rolled paper (not shown), no notch is necessary and each page can be defined by a predetermined number of the holes 8 or by appropriate marks for indicating a change of a page. The marks can be recorded by an appropriate printer (not shown).

The medium is in the form of a paper 5 in the illustrated embodiment, but it is not limited to paper. The medium can be selected in accordance with the style of information recorder which is to be used. For example, the medium can be an ordinary paper, a photosensitive paper, or heat sensitive paper. Alternatively, it is also possible to use a synthetic resin film, a metal-evaporated paper, a fabric, or a metal foil, or the like.

The identification information is, for example, bar codes 10 which are recorded on the paper 5, and which are located, for example, outside the sprocket holes 8 and at the beginning portions of the pages divided by the notches 9, as illustrated in FIG. 2. When other identification information for the purpose of, for example, multi-colour print is necessary, other bar codes 11 are recorded at positions different from the positions of the bar codes 10. Alternatively, it is also possible to include the information which is to be designated by the bar code 11, into the bar codes 10 by increasing the number of bits of the bar codes 10. Furthermore, when the printer includes a punching device, the identification information may be coded holes or coded notches.

As mentioned above, the identification information is usually recorded on each page of the paper 5. However, when certain desired steady information is to be recorded commonly on several successive pages, the identification information can be recorded only on the first page of the several successive pages. Alternatively, it is also possible to arrange a page on which only the necessary identification information is recorded between two pages on which both a steady information and a different steady information is to be recorded.

Figure 3:
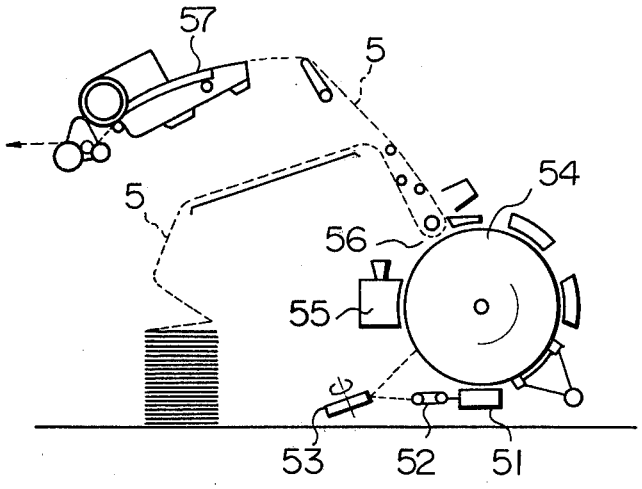
FIG. 3 is a view schematically illustrating an example of a printer used in the present invention.

The first printer 7 may be of a conventionally known type, for example, as illustrated in FIG. 3 it may comprise: means 51 for generating for generating a beam of light, such as a laser; means 52 for modulating and deflecting the beam from the beam generating means 51, in accordance with the variant information and the identification information, said means 52 being, for example, an acoustic optical device driven by a high-frequency power source; means 53 for scanning the beam from the means 52 onto a photoconductive recording medium, such as a cadmium sulfide drum 54, to form latent images of the variant information and the identification information on the medium 54; developer means 55; means 56 for transferring the information on the medium 54 onto the paper 5, and; means 57 for fixing the transferred information on the paper 5. The above described type of printer is disclosed in detail, for example, in "IBM Journal of Research and Development, Vol. 22, No.1, PP1–110, January, 1978". Alternatively, an impact printer type of conventional line printer which can print letters, numerals, the alphabet, and marks in accordance with the content of the variant information, or a non-impact printer type of an ink jet printer or of thermal printer can be also used as the printer 7.

Although the above mentioned embodiment is directed to an off-line operation of the first printer 7 and the second printer 6, it is also possible to provide a buffer, such as a folding machine having a traverse conveyer, to connect the two printers 6 and 7, for the purpose of an on-line operation instead of the off-line operation. Such a folding machine is, for example, described in "OF con-204, by UKITA KOGYO, Japan".

The second printer 6 which prints the steady information on the secondary paper 5B, which has thereon the recorded variant information and the recorded identification information, will now be discussed in detail, with reference to FIG. 4. The printer 6 includes: two inking units 12 and 13 having different coloured inks; a plate cylinder 14; a blanket cylinder 15; an impression cylinder 16; an automatic cleaner 17 for the printing inks; a drying blower 18; a pin feed tractor or tractors 19 for feeding the secondary paper 5B to a printing station between the cylinders 15 and 16; a delivery roller 20 which is brought into contact with and driven by the impression cylinder 16 to discharge the completely printed paper, which is referred to as "a finished paper 5C", from the printing station; a scuffer 21, which is located immediately below a contact point between the impression cylinder 16 and the delivery roller 20, to prevent the finished paper 5C from being adhesively rolled onto the impression cylinder 16; a reader 22, which is located on a path along which the secondary paper 5B is fed, to read the identification information recorded on the paper 5B; an automatic plate feeder 23 for feeding a desired printing plate 26 having desired steady information to the plate cylinder 14, in accordance with an output signal of the reader 22, and; an automatic plate discharger 24 for discharging used printing plates 26 from the plate cylinder 14. The blanket cylinder 15 rotates about a shaft (not shown) which is rotatable but not displaceable, but the plate cylinder 14 and the impression cylinder 16 are both displaceable, in such a manner that they can come into contact with and move away from the blanket cylinder 15. Furthermore, the inking units 12 and 13 are also displaceable, in such a manner that they can come into contact with and move away from the plate cylinder 14.

Automatic plate feeding and discharging system, an inking system, a cleaner for a blanket cylinder, and a displacement mechanism of a plate cylinder and an impression cylinder are described, for example, in Japanese Patent Publication No. 47-42202. A paper feed control system of an offset imprint machine, manufactured by MIYAKOSHI Machine Manufacturing Co., Ltd., Japan can be used in the present invention to control the feed of the continuous paper 5. Furthermore, a paper feeding system and a paper folding system are described, for example, in the above mentioned "IBM Journal of Research and Development".

The automatic plate feeder 23 includes printing plate storing means having a plurality of individually separated shelves 25, each storing or receiving a plurality of printing plates 26 having identical steady information. That is, the number of kinds of printing plates 26 and, accordingly, the number of kinds of steady information on the plates 26 stored in the plate feeder 23, corresponds to the number of shelves 25 of the plates feeder 23. In each shelf 25 there is provided a feed roller 27 which is brought into contact with the printing plate 26 in the corresponding shelf 25, so that the rotation of the feed rollers 27 causes the corresponding printing plates 26 to come out of the shelves 26 one at one time. The plates 26 are then brought onto a belt conveyor 30 opposed to the plate cylinder 14, via guide rollers 28, which are rotated by drive means (not shown), and via a guide 29. The plates cylinder 14 has grippers (not shown) which catch the printing plates 26 conveyed by the conveyer 30, so that the plates 26 can be rolled onto the plate cylinder 14. An Ordinella collator, manufactured by Ordibel Co., Ltd., can be, for example, utilized for the plate feeder 23.

Each printing plate 26 is, for example, a so-called waterless planographic printing plate which is made of a polyester film base on which a photosensitive urethane resin and a silicone having a printing ink-repellency are laminated in that order. When the printing plate is exposed, the portion of the resin that has been exposed is photopolymerized to bond to the silicone, and the portion of the resin that has not been exposed is swollen by a petroleum solvent treatment after the exposure. When the swollen portion is swabbed with a pad, it is separated to form a recess in which the printing inks are to be located.

Such a waterless planographic plate is described in detail, for example, in the Japanese Patent Public Disclosure Nos. 48-94504 and 50-50102. Alternatively, it is also possible to use a planographic printing plate, such as a PS plate (pre-sensitized plate) having a photosensitive layer and a hydrophilic layer, as the printing plate 26. However, when employing this alternative, the additional provision of a damping system is required.

The reader 22 of the identification information or marks is, for example, in the form of a photoelectric device comprising a paired light emitting element and light sensitive element (not shown). When the secondary paper 5B has the identification information 10 and 11 on its opposite sides, respectively, as illustrated in FIG. 2, two readers 22, corresponding to the informations 10 and 11, are necessary. The light emitting element, such as a light emitting diode, and the light sensitive element, such as a photo diode, are located above or below the secondary paper 5B when the identification information is in the form of bar codes, so that the light sensitive element can detect the amount of light which is emitted by the light emitting element and which is reflected from the secondary paper 5B, to read the identification information. Alternatively, when the identification information is in the form of corded holes, slits or the like, one of the light emitting element and the light sensitive element is located above the secondary paper 5B and the other element is located below the same, that is, the secondary paper 5B passes between the two elements, so that the light sensitive diode can detect the amount of light which passes the coded holes or slits.

When the reader 22 reads the identification information, the feed roller 27 corresponding to the output signal of the reader can be rotated to withdraw the printing plate 26 on which is provided the steady information corresponding to the identification information read by the reader 22, from the corresponding shelf 25 of the plate feeder 23. As a result, a desired printing plate 26 can be fed and attached onto the plate cylinder 14.

The second printer 6 operates as follows. The reader 22 reads the bar codes 10 on the secondary paper 5B fed by the tractor 19 and identifies the kind and the colour of the steady information which is to be printed. When the reader 22 finds that the printing plate 26 which is in use has to be replaced by another one stored in the plate feeder 23, or the printing ink has to be changed to another coloured printing ink, the plate cylinder 14 and the impression cylinder 16 are separated from the blanket cylinder 15 after the printing by the printing plate 26 is completed. At the same time, the tractor 19 is stopped and the delivery roller 20 is separated from the impression cylinder 16, thus resulting in stoppage of the movement of the secondary paper 5B. The inking unit 12 or 13 which has been in contact with the plate cylinder 14 is also separated from the latter.

After that, the blanket cylinder 15 is cleaned by the cleaner 17 and, then, the blower 18 is operated to dry the cleaned blanket cylinder 15. When not only a change of the printing colour but, also, replacement of the printing plate 26 is necessary, the replacement of the printing plate on the plate cylinder 14 is effected during the cleaning operation of the blanket cylinder 15. That is, the plate discharger 24 is operated to release the gripper (not shown) of the plate cylinder 14 in order to allow removal of the plate 26 on the plate cylinder 14 from the latter. After that, as mentioned above, a new printing plate 26, which is designated by the bar codes 10, is fed onto the plate cylinder 14 by the plate feeder 23.

Then, the inking unit 12 or 13 having a colour of printing ink which is designated by the bar codes 10 is brought again into contact with the plate cylinder 14. Furthermore, the plate cylinder 14 and the impression cylinder 16 are brought into contact with the plate cylinder 14, in a timed relationship. At the same time, in order to begin the feed and the print of the secondary paper 5B again, the tractor 19 is again operated and the delivery roller 20 is brought into contact with the impression cylinder 16. The print and the feed is continued for the successive pages of the secondary paper 5B on which are to be printed the identical steady information.

The above mentioned operation is repeated everytime the content of the steady information to be printed on the secondary paper 5B is changed.

It should be noted that one operation can be only make a single colour print for one page of the paper. Therefore, if two-colour printing is required, the paper has to be printed twice. That is, after the first colour printing is effected on the secondary paper 5B in the above mentioned printing process, the finished paper 5C thus obtained is fed again to the printer 6 in which is now set a desired second colour inking unit 12 or 13, to effect the second colour printing in the same printing process. In the case of the two-colour printing, the identification of the printing colour can be achieved by the bar codes 11 on the second paper 5B. If multi-colour printing is necessary, the same number of printing operations as the number of printing colours are repeated in accordance with additional bar codes which are recoded on the secondary paper.

When there is a page on which no printing is necessary, the plate cylinder 14 and the impression cylinder 16 are separated from the blanket cylinder 15, so that the secondary paper 5B is fed by the tractor 19 and the delivery roller 20 without being subjected to any printing operation. Such a feed operation with no printing operation can be also adapted to print a colour only on a specified page in a multi-colour printing process. That is, for example, when it is necessary to alternate two colours and two kinds of printing plates between successive pages of the paper, the first printing operation is directed only to, for example, odd numbered pages, and the second printing operation is directed only to the remaining pages, i.e. even numbered pages. In such a case, in the first printing operation, even numbered pages are fed without being subjected to any printing operation, and in the second printing operation, odd numbered pages are fed without being subjected to any operation. Thus, a single operation is necessary to alternate the colour and the printing plate between the first and the second printing operations, resulting in an improvement of the printing operation of the printer and of the service life thereof, in comparison with the prior art.

In the above described embodiment, there is no discussion directed to a sequence circuit for effecting the sequential operation of the printer. However, such a sequential operation or control can be easily achieved by the utilization of, for example, a microcomputer and a control device which operates in response to the microcomputer.

Figure 5:
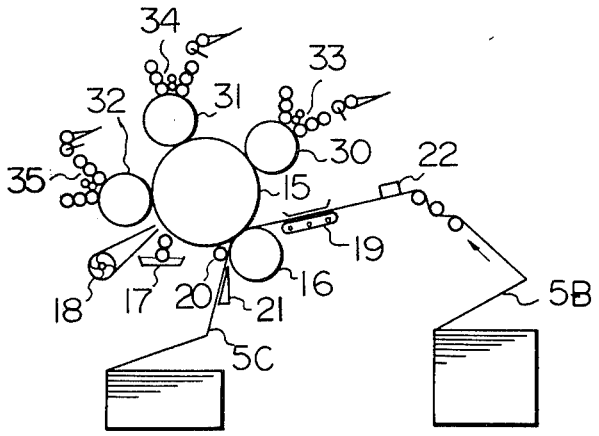

Another embodiment of the second printer 6 is illustrated in FIG. 5. In this embodiment, three plate cylinders 30, 31 and 32, each having a diameter one half of the diameter of the blanket cylinder 15, are provided for one blanket cylinder 15. These three plate cylinders are provided with identical or different printing plates (not shown), and three inking units 33, 34 and 35 having identical or different colour inks. The plate cylinders 30, 31 and 32 are in phase with the blanket cylinder 15, so that the steady information is transferred onto the identical portion of the blanket cylinder 15 from the three plate cylinders.

Figure 4:
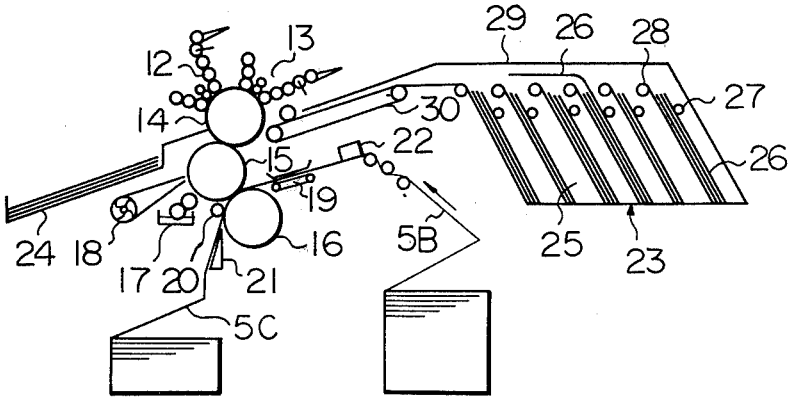
FIGS. 4 to 6 are views similar to FIG. 1 and illustrating three different embodiments of the invention.

Also, in the embodiment illustrated in FIG. 5, similar to the embodiment illustrated in FIG. 4, the blanket cylinder 15 is not displaceable, but the plate cylinders 30, 31 and 32, and the impression cylinder 16 are independently displaceable in such a manner that they can separate from the blanket cylinder 15, thereby to enable selection of the steady information and control of the feed of the paper. Furthermore, the inking units 33, 34 and 35 can move close to and away from the respective plate cylinders 30, 31 and 32.

The length of each page in the longitudinal direction of the paper is one of factors of the steady information. In the embodiment illustrated in FIG. 5, the impression cylinder 16 is separated from the blanket cylinder 15 each time a page is printed, so as to enable intermittent feed the secondary paper 5B. That is, the paper 5B is alternately moved and stopped. Therefore, the printer can print the steady information on the paper in accordance with the length of each page, by adjusting the time ratio between a period during which the paper is moved and a period during which the paper is stopped, without changing the diameters of the plate cylinders and the blanket cylinder 15.

The printer illustrated in FIG. 5 provides seven combinations of forms and colours of steady information, by changing the combination of the plate cylinder or cylinders which is or are brought into contact with the blanket cylinder 15, without replacing either the colour inks or the plate cylinders. That is, the number N of combinations is given by the following equation.

$$N={}_3C_1+{}_3C_2+{}_3C_3=7$$

It will be understood that: ${}_3C_1$ designates three combinations consisting of ① print by using the plate cylinder 30 only, ② print by using the plate cylinder 31 only, and ③ print by using the plate cylinder 32; ${}_3C_2$ designates three combinations consisting of ④ print by using 30 and 31, ⑤ print by using 30 and 32, and ⑥ print by using 31 and 32, and; ${}_3C_3$ designates one combination of ⑦ print by using all of 31, 32 and 33.

Figure 6:
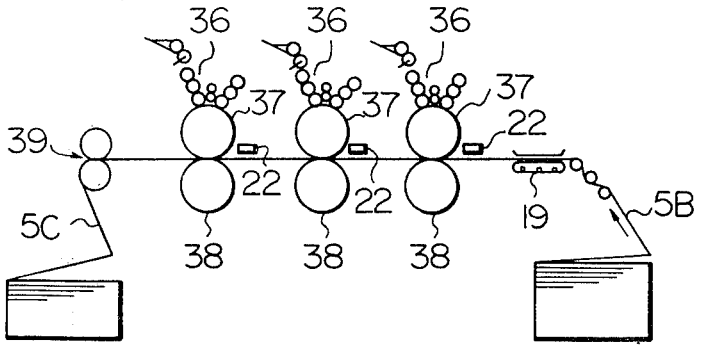

Still another embodiment of the second printer 6 is illustrated in FIG. 6. This embodiment is particularly adaptable for relief printing, intaglio printing or planographic direct printing. No blanket cylinder is provided in the printer illustrated in FIG. 6. The printer includes three identical printing units, each consisting of an inking unit 36 having printing inks, a plate cylinder 37 and an impression cylinder 38. These printing units are arranged in series along the direction of the feed of paper 5B. The three printing units are spaced from one another at a distance which is an integral number times the length of one page of the paper 5. The plate cylinders 37 of the printing units are in phase with each another. The numeral 39 designates nip rolls for discharging the finished paper 5C which is completely printed. In this embodiment, the plate cylinders 37 are radially displaceable to come into contact with and move away from the respective impression cylinders 38 which are immovable in the radial direction.

In the embodiment illustrated in FIG. 6, the kinds of printing plates provided on the plate cylinders and the colours of printing inks of the inking units in the printing units can be optionally selected. Therefore, the printer illustrated in FIG. 6 can effect three-colour printing by using all of the inking units at one time, in accordance with the output signals of the respective readers 22. Of course, a signal inking unit, or two of the inking units in combination, can be used at one time. The number N of combinations is seven also in this embodiment, as in the embodiment of FIG. 5, when neither the printing plates on the plate cylinders not the printing inks are replaced by other ones. Since the above mentioned seven combinations require no replacement of the printing plates to print different steady information on different pages, it is not always necessary to intermittently feed the paper even when, for example, the steady information to be printed must be changed for every page of the paper. That is, a continuous feed of the paper is possible.

In the embodiments illustrated in FIGS. 5 and 6, it is also possible to provide one or a plurality of automatic plate feeders 23 as shown in FIG. 4, for each or a part of the plate cylinders, so that automatic exchange and selection of the printing plates can be performed, and that a large number of kinds of steady information can be printed.

Furthermore, although the embodiments mentioned above are all directed to types of printers which use printing inks, the present invention can be adapted for an electrostatic printing process type of printer or a magnetic printing process type of printer which uses a toner, or in particular, a retention system printer in which latent images on a magnetic drum are repeatedly utilized, (cf. Japanese Patent Public Disclosure Nos. 52-33739 and 53-99949), or a printer in which is used a master paper having magnetic latent images or electrostatic latent images (cf. Japanese Patent Public Disclosure Nos. 50-11243 and 52-139516). In the above mentioned modifications, effective exchanging of the steady information, multi-colour printing and speedy printing can be expected.

As will be understood from the above discussion, according to the present invention, the desired variant information and the identification information which designates the steady information to be recorded later are first recorded on a medium, such as the primary paper 5A, by the first printer 7, and then, the secondary paper 5B thus obtained is fed to the second printer 6 in which the desired steady information is recorded. In order to record the steady information, the second printer essentially includes means for reading the identification information on the secondary paper 5B to select the desired steady information corresponding to the identification information from a plurality of pre-stored steady information groups, and for recording the selected steady information onto the secondary paper.

In a conventional known printer, not only is it necessary to prepare and store in advance various kinds of pre-printed papers which have pre-printed steady portions but, also, it is necessary to classify the pre-printed papers into several groups, each group's papers having the same of steady portions, when they are fed to the printer. However, according to the present invention, such preparation, storage and classification are unnecessary.

Furthermore, as mentioned above, another known printer according to the prior art, which is controlled by a computer unit in which several kinds of steady information are stored, to print the steady information and variant information at one time on a primary paper, has the drawbacks that the printing quality of the steady portions and the printing speed are rather low, and that it is difficult to print in multi-colour on the steady portion. However, such drawbacks can be eliminated by the present invention.

Finally, according to the present invention, high quality, high speed and high productivity printing can be ensured, and the present invention is useful in particular for production of various kinds of print.

What is claimed is:

1. A method for ink-printing at least one steady information onto a continuous paper which has a series of perforations or sprocket holes on both sides along the length of said paper for controlling the feed of said paper which has at least one prerecorded variant information and at least one prerecorded identification information for identifying the steady information to be ink-printed with a predetermined positional relationship to the steady information, comprising:

(a) feeding said continuous paper to an ink printing station by pin feed tractor means;

(b) reading the recorded identification information to select a desired steady information corresponding thereto from a plurality of pieces of steady information;

(c) storing steady information at a storage location separate from said ink printing station by means of a storage receptacle adapted to hold a plurality of printing plates having different steady information and storing members for separately storing the different printing plates;

(d) selecting steady information by means of printing plate feeding members constructed and arranged for selecting and taking out a printing plate corresponding to the read identification information from the storing members;

(e) feeding said printing plate from the storage location to said ink printing station;

(f) attaching the selected printing plate onto a plate cylinder;

(g) reading prerecorded identification information for identification of the correct color printing ink;

(h) selecting and applying the correct color printing ink;

(i) printing steady information by means comprising said blanket cylinder which is disengageably engaged by said plate cylinders which disengageably come into contact with said blanket cylinder.

2. A method for ink-printing at least one steady information onto a continuous paper which has a series of perforations or sprocket holes on both sides along the length of said paper for controlling the feed of said paper which has at least one prerecorded variant information and at least one prerecorded identification information for identifying the steady information to be ink-printed with a predetermined positional relationship to the steady information, comprising:

(a) feeding said continuous paper to an ink-printing station by pin feed tractor means;

(b) reading the recorded identification information to select a desired steady information corresponding thereto from a plurality of pieces of steady information;

(c) storing steady information at a storage location separate from said ink-printing station by means comprising a storage receptacle adapted for holding a plurality of printing plates having different steady information and storing members for separately storing the different printing plates;

(d) selecting steady information by means comprising printing plate feeding members constructed and arranged for selecting and taking out printing plates corresponding to the read identification information from the storing members;

(e) feeding said printing plate from the storage location to said ink-printing station;

(f) attaching the selected printing plates onto multiple plate cylinders, said plate cylinders being selectively brought into contact with a common blanket cylinder;

(g) reading prerecorded identification information for identification of the correct color printing ink;

(h) selecting and applying the correct color printing ink wherein multiple inking units are provided for the plate cylinders;

(i) printing steady information by means comprising said blanket cylinder which is disengageably engaged by said plate cylinders which disengageably come into contact with said blanket cylinder.

3. An apparatus for ink-printing at least one steady information onto a continuous paper which has a series of perforations or sprocket holes on both sides along the length of said paper for controlling the feed of said paper which has at least one prerecorded variant information and at least one prerecorded identification information for identifying the steady information to be ink-printed with a predetermined relationship to the steady information, comprising (a) a blanket cylinder;

(b) an impression cylinder which disengageably comes into contact with said blanket cylinder:

(c) a plate cylinder which disengageably comes into contact with said blanket cylinder;

(d) an inking unit for providing a desired ink on a printing plate having a desired steady information disengageably attached to said plate cylinder;

(e) a pin feed tractor for feeding said continuous paper to an ink-printing station between said blanket cylinder and said impression cylinder:

(f) means for discharging said continuous paper from said ink-printing station;

(g) means for reading said identification information recorded on said continuous paper, which is located on a path along which said continuous paper is fed to said ink-printing station;

(h) steady information storing means comprising a storage unit separate from said ink-printing station adapted to hold a plurality of individual printing plates having different steady information and storing members for separately storing the printing plates;

(i) means for automatically taking out a desired printing plate from one of said storing members corresponding to the identification information read by said means for reading said identification information;

(j) means for feeding said printing plate onto said plate cylinder;

(k) means for mounting said printing plate on said plate cylinder; and (l) means for discharging said printing plate from said plate cylinder.

4. An apparatus according to claim 3, wherein said apparatus further comprises another inking unit for providing a desired different colored ink on a printing plate having desired steady information disengageably attached to said plate cylinder.

5. An apparatus according to claim 3, wherein said apparatus further comprises another plate cylinder which disengageably comes into contact with said blanket cylinder and another inking unit for providing a desired different colored ink on a printing plate having a desired steady information disengageably attached to said another plate cylinder.

6. An apparatus for ink-printing at least one steady information onto a continuous paper which has a series of perforations or sprocket holes on both sides along the length of said paper for controlling the feed of said paper which has at least one prerecorded variant information and at least one prerecorded identification information for identifying the steady information to be ink-printed with a predetermined relationship to the steady information, comprising (a) an impression cylinder;
(b) a plate cylinder which disengageably comes into contact with said impression cylinder;
(c) an inking unit for providing a desired ink on a printing plate having a desired steady information disengageably attached to said plate cylinder;
(d) a pin feed tractor for feeding said continuous paper to an ink-printing station between said plate cylinder and said impression cylinder;
(e) means for discharging said continuous paper from said ink-printing station;
(f) means for reading said identification information recorded on said continuous paper, which is located on a path along which said continuous paper is fed to said ink-printing station;
(g) steady information storing means comprising a storage unit separate from said ink-printing station adapted to hold a plurality of printing plates having different steady information and storing members for separately storing the different printing plates;
(h) means for automatically taking out a desired printing plate from one of said storing members corresponding to the identification information read by said means for reading said identification information;
(i) means for feeding said printing plate onto said plate cylinder;
(j) means for mounting said printing plate on said plate cylinder; and
(k) means for discharging said printing plate from said plate cylinder.

7. An apparatus for ink-printing at least one steady information onto a continuous paper which has a series of perforations or sprocket holes on both sides along the length of said paper for controlling the feed of said paper which has at least one prerecorded variant information and at least one prerecorded identification information for identifying the steady information to be ink-printed with a prerecorded relationship to the steady information, comprising (a) a plurality of printing units each of which comprises
  (i) an impression cylinder,
  (ii) a plate cylinder which disengageably comes into contact with said impression cylinder,
  (iii) an inking unit for providing a desired ink on a printing plate having a desired steady information disengageably attached to said plate cylinder,
  (iv) a steady information storing means comprising a storage unit separate from said ink-printing station adapted to hold a plurality of printing plates having different steady information and storing members for separately storing the different printing plates,
  (v) means for automatically taking out a desired printing plate from one of said storing members corresponding to the identification information read by said means for reading said identification information,
  (vi) means for feeding said printing plate onto said plate cylinder,
  (vii) means for mounting said printing plate on said plate cylinder, and
  (viii) means for discharging said printing plate
(b) a pin feed tractor for feeding said continuous paper to an ink-printing station between said plate cylinder and said impression cylinder in the first unit of said printing units;
(c) means for discharging said continuous paper from said ink-printing station in the last unit of said printing units;
(d) means for reading said identification information recorded on said continuous paper, which is located on a path along which said continuous paper is fed to said ink-printing station; and
(e) each of said inking units being provided with different colored ink.

* * * * *

UNITED STATES PATENT AND TRADEMARK OFFICE

CERTIFICATE OF CORRECTION

PATENT NO. : 4,328,749

DATED : May 11, 1982

INVENTOR(S) : Inouye et al.

It is certified that error appears in the above-identified patent and that said Letters Patent are hereby corrected as shown below:

Col. 6, line 31, after "shelves" delete "26" and insert --25--;

line 53, after "planographic" insert --printing--.

Col. 11, line 36, delete "said" and insert --a--;

line 37, delete "cylinders" and insert --cylinder--.

Col. 14, line 3, delete "prerecorded" and insert --predetermined--;

line 23, delete "said" (first occurrence).

Signed and Sealed this

Tenth Day of August 1982

[SEAL]

Attest:

GERALD J. MOSSINGHOFF

Attesting Officer

Commissioner of Patents and Trademarks